United States Patent [19]

Goby

[11] 4,389,800

[45] Jun. 28, 1983

[54] LAND LEVELING SCRAPERS

[75] Inventor: Larry G. Goby, McAllen, Tex.

[73] Assignee: Reynolds Manufacturing Company, McAllen, Tex.

[21] Appl. No.: 351,502

[22] Filed: Mar. 1, 1982

[51] Int. Cl.[3] ..... E02F 5/00

[52] U.S. Cl. ..... 37/124; 37/129

[58] Field of Search ..... 37/124, 126 R, 126 A, 37/126 AE, 126 AA, 126 AB, 126 AC, 126 AD, 128, 129, 8, 4, DIG. 13

[56] References Cited

U.S. PATENT DOCUMENTS

| | | | |
|---|---|---|---|
| 1,924,359 | 8/1933 | Harrison | 37/129 X |
| 2,231,625 | 2/1941 | Henry et al. | 37/129 |
| 2,441,744 | 5/1948 | Barker | 37/129 |
| 4,308,677 | 1/1982 | Behm | 37/129 |

*Primary Examiner*—E. H. Eickholt

*Attorney, Agent, or Firm*—Vaden, Eickenroht, Thompson, Bednar & Jamison

[57] ABSTRACT

There is disclosed a land leveling scraper having skid shoes whose bottom surfaces are free to accommodate and follow irregularities in the ground surface being leveled, and are urged against the ground surface with a force proportional to the load on the bucket of the scraper.

10 Claims, 6 Drawing Figures

11
10
17
20
19
28
26
14
24
25
15
13
21
22
23
12
16A 11
16
17
20
19
28
27
30
31
32
35
33
18B
14
26
24
15
13
21
22
12

LAND LEVELING SCRAPERS

This invention relates generally to land leveling scrapers of the type in which a bucket is supported by a frame having a front end attachable to a towing vehicle and a rear end supported by wheels having pneumatic tires, and a cutting edge across the lower edge of the open front of the bucket is adapted to be raised or lowered to a desired grade with respect to the ground surface. More particularly, it relates to improvements in scrapers of this general type in which skid shoes are mounted on the frame for engaging the ground surface at approximately grade level in order to absorb part on the load of the bucket, and thus lessen the tendency of the cutting edge to rise above or fall below grade due to flattening of the tires of the wheel as they "bounce" over irregularities in the ground surface. In one of its important aspects, this invention relates to improved scrapers of this type wherein the frame has front and rear sections which are pivotally connected in such a manner that the wheels are raised or lowered, so as to respectively lower or raise the cutting edge of the bucket, in response to extension or retraction of hydraulically operated actuators connected between the frame sections.

Due to this tendency of the wheels to bounce, the degree of which increases with load on the bucket, it was common practice, in land leveling operations, to use a land plane for precision leveling or "finishing" operations following initial smoothing of the ground surface by means of a scraper of the latter type to within approximately ¼" of grade, plus or minus. It has been proposed to mount the above-described skid shoes on such scrapers in an effort to avoid this duplication of equipment, and instead perform the entire land leveling operation with multiple passes of the scraper. In some cases, it has been proposed to mount the skid shoes on the front frame section from which a towing tongue extends, and, in others, on the rear frame section on which the wheels are carried; and, in any event, to mount the skid shoes on the frame section to which the bucket is secured, which, as known in the art, may be either the front or rear section.

In either event, these prior skid shoes have comprised generally flat plates each mounted on the frame by a generally vertically extending rod having its lower end pivotally connected to the plate intermediate its ends and its upper end slidably and adjustably received within slots in the frame to permit the midportion of the plate to be raised or lowered, and a pin pivotally connected to the forward end of the plate and threadedly received within a socket on the frame to permit the plate to be tilted about its pivotal connections to the rod. In this way, an effort was made to adjust the plate, prior to use, to approximately the grade level to which the cutting edge of the bucket was to be held, and thus attempt to maintain maximum surface contact with the ground surface.

Although these performed reasonably well when moving over level ground, they were incapable of maintaining full ground contact, and thus absorbing the intended load, as they moved over uneven ground. Also, even after adjustment, they often tilted either downwardly, so that front ends dug into the ground surface, or rearwardly, so that their rear ends dug in. Furthermore, there was no way to adjust the plates for wear other than while the scraper was not in use.

An object of this invention is to provide a scraper of the type described in which the skid shoes automatically adjust to irregularities in the ground surface as well as for wear so as to maintain maximum contact with the ground surface even as the load on the bucket increases.

This and other objects are accomplished, in accordance with the illustrated embodiment of the invention, by a scraper of the type described wherein the forward end of each of a plurality of skid plates is pivotally connected to the frame, and legs having their upper ends pivotally connected to the frame have lower ends pivotally connected to the skid plates rearwardly of the forward end thereof. More particularly, one end of such leg has a cylinder and the other having a piston slidable within the cylinder to form a variable volume pressure chamber on one side of the piston connectible to a source of hydraulic fluid under pressure in order to yieldably urge the lower leg to extended position and thus the bottom surface of the plate against the ground surface. Consequently, each plate will conform to and maintain contact with the contour of the ground surface, as the scraper moves forwardly over the ground surface, regardless of irregularities in the surface and/or wear on the bottom surface of the skid plate.

In the preferred and illustrated embodiment of the invention, the pivotal connection of the front end of each skid plate to the frame comprises a link pivotally connected at one end of the frame and at the other end to the front end of the skid plate, and the piston and cylinder of each leg form an extendible and retractible actuator so that hydraulic fluid may be supplied to the other side of the piston for retracting the leg to lift the skid plate above the cutting edge. Thus, in accordance with an additionally novel feature of the present invention, the cutting edge of the bucket to be lowered to grade without interference by the skid plate. More particularly, and in accordance with a still further novel aspect of the invention, a means is also provided for urging the shoe against the ground surface with a force which is proportional to the load on the bucket, whereby the shoes are caused to absorb a greater proportion of the load during maximum amplitudes of vibration of the bucket. Thus, the means for raising and lowering the cutting edge of the bucket comprises an hydraulically operated, cylinder and piston type actuator, which is so connected to the actuator for each of the skid plate supporting legs that, upon blocking of the flow of hydraulic fluid to or from the source of hydraulic fluid, the shoes are so urged against the ground automatically in response to the increased pressure generated in the frame actuator by the bucket load.

As illustrated, the frame is of the type above described wherein a front section is adapted for connection to a towing vehicle, and a rear section pivotally connected to the front section carries wheels having pneumatic tires. In this illustrated and preferred embodiment, hydraulic fluid is provided from a common source to and from opposite sides of the pistons of the actuators for the frame as well as those for the skid shoes. As also illustrated, the bucket and skid shoes are mounted from the front frame section, with the actuators connecting the frame sections being retracted to raise the wheels and thus lower the cutting edge, as the leg actuators are retracted to raise the skid shoes, and extended to lower the wheels and thus raise the cutting edge as the leg actutators are extended to lower the skid shoes.

In the drawings, wherein like reference characters are used throughout to designate like parts:

FIG. 1 is a side view of a land leveling scraper constructed in accordance with the present invention, with the cutting edge of the bucket thereof lowered to the grade to which ground surface is to be leveled, and with the side wall of the bucket broken away to show the skid shoes lifted above the cutting edge of the bucket to facilitate its lowering;

FIG. 2 is a side view of the scraper, similar to FIG. 1, but upon lowering of the wheels thereof into engagement with the ground surface to transfer part of the load of the bucket onto the wheels preparatory to towing of the scraper in a forward direction to level the ground surface to the desired grade, the bucket side wall again being broken away to show the skid shoes in position for sliding over the ground surface;

Figure 1:
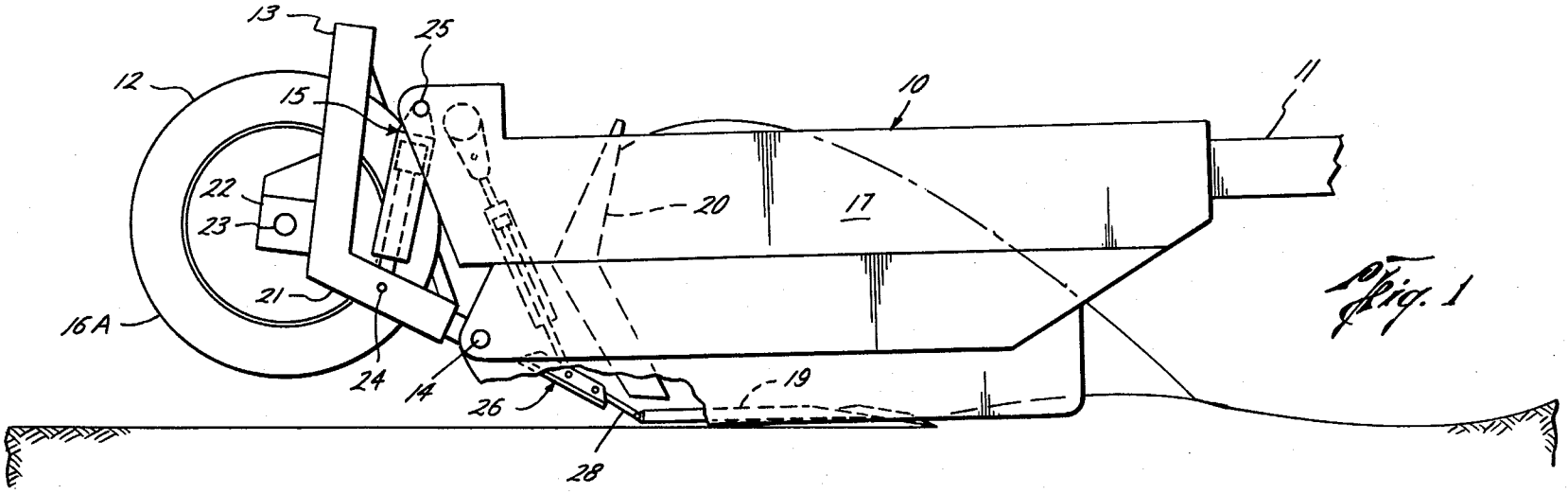

With reference now to the above-described drawings, and particularly FIGS. 1 to 3 and 5, the overall scraper includes a frame having a first section to which a bucket 10 is secured and a tongue 11 extending forwardly of the bucket for connection to a towing vehicle (not shown), and a second section having wheels 12 mounted on a carriage 13 pivotally connected to the bucket and thus the first section by means of pins 14. An hydraulically operated, extendible and retractible actuator 15 is pivotally connected at its ends between the bucket and the carriage on each opposite side of the frame so as to permit a cutting edge 16 across the lower edge of the open front end of the bucket 10 to be raised or lowered with respect to the wheels.

Figure 2:
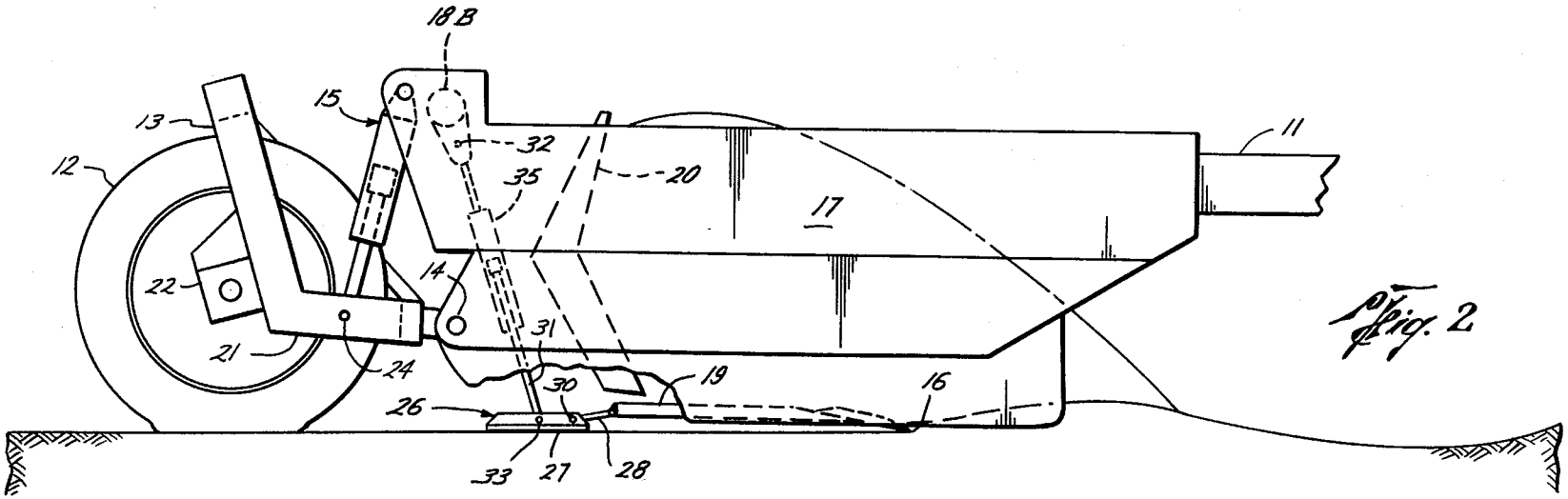
Figure 3:
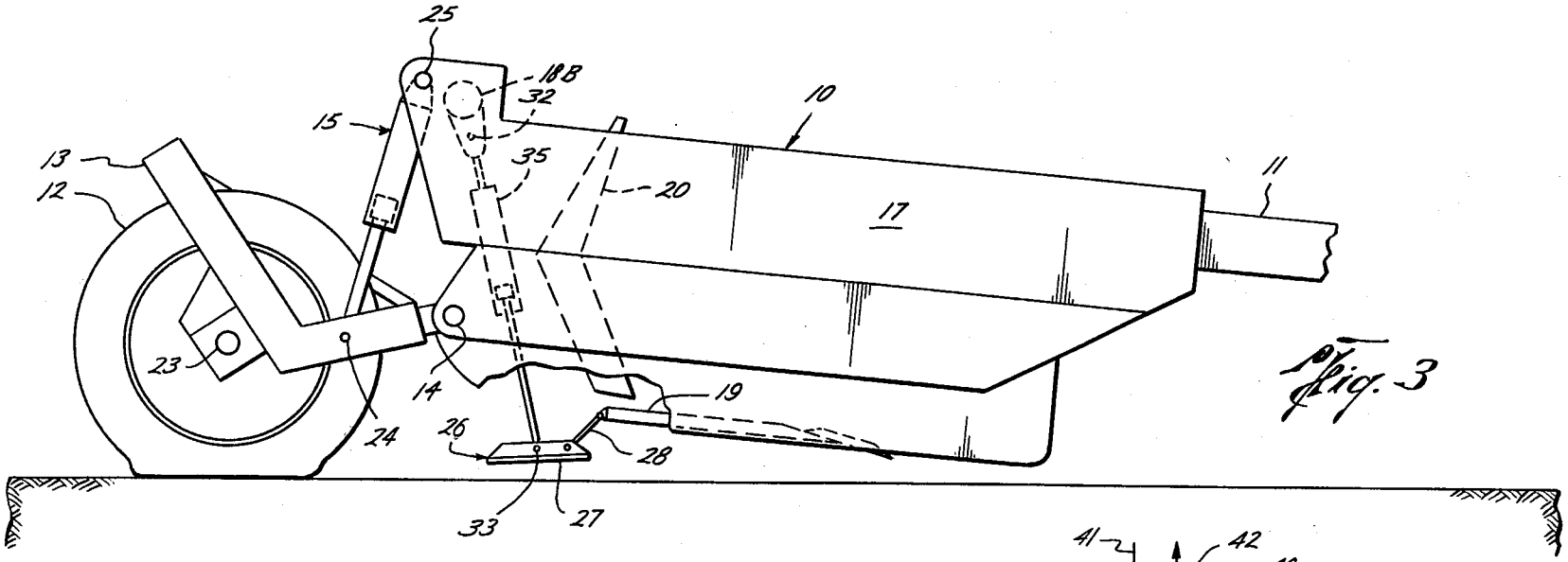
FIG. 3 is a view similar to FIGS. 1 and 2, but upon further lowering of the scraper wheels so as to lift the bucket and its cutting edge above ground surface preparatory to transport of the scraper to another location.

Upon retraction of the actuator, as shown in FIG. 1, the wheels of the scraper are raised so as to lower the bucket and its cutting edge to the desired grade for leveling purposes. The actuator may then be partially extended, as shown in FIG. 2, to lower the wheels into engagement with the ground surface rearwardly of the cutting edge, and thus transfer a portion of the load of the bucket to the wheels. As shown in FIG. 3, actuator 15 may be fully extended so as to transfer all of the load to the wheels and thereby raise the cutting edge 16 above the ground surface preparatory to transporting the scraper to another location. As can be seen from a comparison of FIGS. 2 and 3, this further load of the wheels is reflected by further flattening of the pneumatic tires 16A of the wheels 16.

The bucket 10 has side walls 17 which are interconnected by laterally extending cross beams 18A and 18B, and a bottom wall 19 which extends between the lower edges of the side walls 17 generally intermediate the forward and rearward ends of the bucket. The open front end of the bucket permits soil which is cut by the cutting edge 16 to move into the bucket and accumulate on the bottom wall 19, and the rear end of the bucket is closed by means of a gate 20 extending laterally between the side walls of the bucket. Preferably, the gate is adapted to be moved forwardly and rearwardly (by means not shown) so that, with the bucket raised to the position shown in FIG. 3, it may remove soil accumulated in the bucket.

Figure 6:
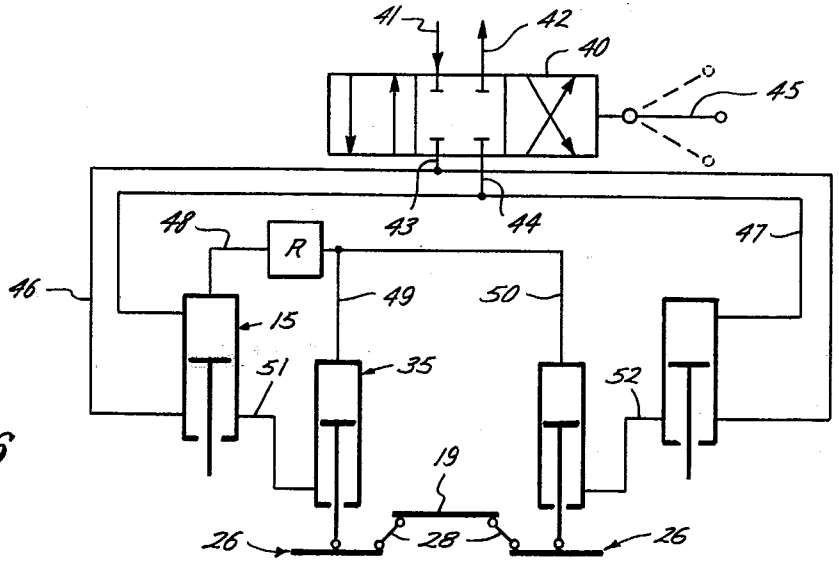
FIG. 6 is a diagrammatic illustration of the hydraulic system including hydraulically operated actuators for raising and lowering the cutting edge of the bucket and the skid shoes.
Figure 4:
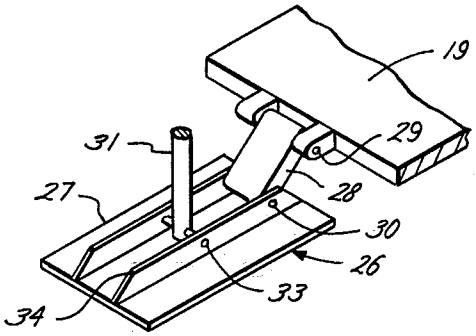
FIG. 4 is a detailed perspective view of one of the skid shoes including a link by which its front end of the plate thereof is connected to the bottom wall of the bucket and the lower end of a leg from which an intermediate portion of the plate is supported from the bucket.

The carriage 13 comprises generally L-shaped, side members 21 connected at their upper and inner ends by cross beams 22A and 22B and reinforced by braces 22C extending between the beams. Pins 14 pivotally connect each opposite side of the forward ends of the carriage to the adjacent side walls of the bucket, and journal boxes 22 are mounted on the rear sides of the L-shaped members 21 to support axle 23 for the wheels. As shown in FIG. 6, there are two pairs of tandem wheels 12, each generally to one side of the frame, although additional sets may be provided depending on the width of the overall scraper.

The lower, rod ends of actuators 15 are pivotally connected to the forwardly extending portion of the L-shaped members by means of pins 24, and the upper, cylinder ends of the actuators are pivotally connected to the upper rear corner of the bucket side walls by means of pivot pins 25. As the wheels swing downwardly from the position of FIG. 1 to the position of FIG. 3, the axes of pins 24 move from above to below an imaginary line extending through the axis of pins 14 parallel to the bottom wall of the bucket. As well known in the art, however, in other scrapers of this general type, the bucket may be fixed to the second or rear frame section so as to swing with the wheel carriage, and the actuator connecting the frame sections otherwise arranged to lower the wheels upon retraction rather than extension of the actuator. Thus, the particular construction and arrangement of the frame shown is merely for purposes of illustration.

Figure 5:
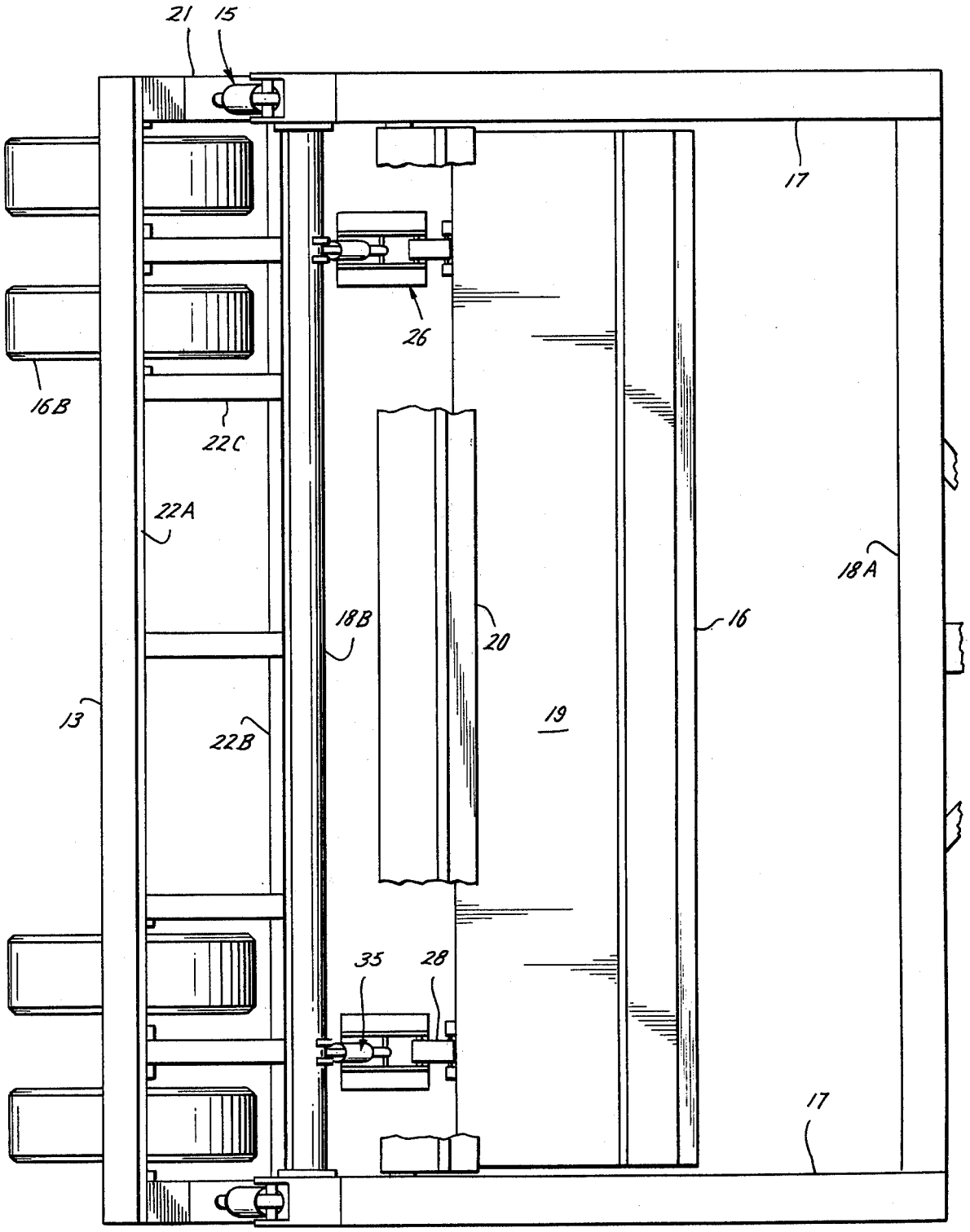
FIG. 5 is a top plan view of a portion of the scraper including the bucket and wheel carriage.

Each of the skid shoes 26 comprises a flat plate 27 having its forward end pivotally connected by a pin 30 to link 28 pivotally connected by a pin 29 to the rear end of bottom plate 19 of the bucket. Thus, as each shoe is pulled forwardly with the bucket, it may be raised (FIG. 1) or lowered (FIG. 3) from an intermediate position (FIG. 2) on essentially the same level as the cutting edge 16 of the bucket, and when the shoe is raised, its front end is above the bottom of the bucket. Each plate is supported intermediate its front and rear ends by means of a leg 31 which extends forwardly and downwardly behind the rear wall 20 of the bucket, with the upper end of the leg being pivotally connected to the cross beam 18B of the bucket by means of a pin 32 and its lower end pivotally connected to spaced-apart flanges 34 on the top side of the plate by a pin 33. More particularly, and as will be described to follow, the leg includes means by which it may be extended and retracted so that the flat bottom surface of each plate may assume the contour of the ground surface over which it slides during forward movement of the scraper and thus maintain maximum contact with the ground surface. As shown in FIG. 5, there are two such skid shoes, each disposed generally laterally intermediate the wheels of each tandem set of wheels, and longitudinally intermediate the rear end of the bottom wall of the bucket and the aligned tandem set of wheels.

Leg 31 is extended and retracted by means of an hydraulically operated actuator 35 having the cylinder thereof connected to the upper end of the rod and the piston thereof connected to the lower part of the rod. Upon retraction of the actuator, as shown in FIG. 1, the skid shoe is lifted above the bottom wall 19 of the bucket, and thus the cutting edge 16 so as to avoid interference with lowering of the cutting edge to the desired grade for leveling purposes. Upon partial extension of the actuator, as shown in FIG. 2, the skid shoe may be lowered into engagement with the ground surface and thus into position to absorb shock and dampen vertical fibrations of the cutting edge, as previously described. Upon full extension of the actuator 35, and following lifting of the bucket for transport, as shown in FIG. 3, the skid shoe is lowered beneath the bottom wall 19 of the bucket.

Each of the actuarors 15 connecting the sections of the frame for raising or lowering the wheels thereof, as well as each of the actuators 35 for raising and lowering the skid shoes, is caused to extend and contract by means of an hydraulic system which includes a source (not shown) of hydraulic fluid conveniently carried by the tractor or other vehicle by means of which the scraper is towed, and a shuttle valve 40 which, together with suitable hydraulic lines controls the flow of hydraulic fluid between such source and the oppositely facing pressure-responsive surfaces of the actuator pistons.

Thus, as shown in the diagrammatic illustration of FIG. 6, a first hydraulic line 41 connecting with the shuttle valve 40 leads from the supply side of the source of hydraulic fluid, and a second line 42 connecting therewith leads to the exhaust side of the source. Additional hydraulic lines 43 and 44 connect the shuttle valve 40 with the actuator cylinders on opposite sides of the actuator pistons to either supply hydraulic fluid thereto or exhaust hydraulic fluid therefrom, or alternatively prevent the flow of hydraulic fluid between the source and the actuators, depending on the position of the shuttle valve. Thus, with the shuttle valve in the intermediate position shown in FIG. 6, flow between the conduits 41 and 42 and the conduits 43 and 44 is blocked or interrupted so that no hydraulic fluid flows to or from the source. Upon shifting of the shuttle valve, by means of the handle 45, to the right, the line 41 is connected with the line 43, and the line 42 is connected with the line 44. Alternately, upon shifting of the shuttle valve to the left, line 41 is connected with line 44, and line 43 is connected with line 42.

As also shown in FIG. 6, line 43 is connected with line 46 having branches which connect with the rod ends of each of the actuators 15, and line 44 connects which branches of line 47 connecting with the piston ends of the actuaors 15. In this way, upon shifting of valve 40 to the right, the pistons of the actuators 15 are caused to move upwardly to retract the actuators and thus, as previously described, and as shown in FIG. 1, raise the wheels 12 in order to lower the bucket and its cutting edge 16. Upon reversal of the shuttle valve—i.e., upon movement to the left, the pistons of actuators 15 are moved downwardly to extend the actuators and thereby move the wheels downwardly in order to lift the bucket and its cutting edge, as shown in FIG. 3. Alternatively, the shuttle valve may be so manipulated as to partially extend or retract the actuators, as shown in FIG. 2, in order to merely transfer part of the load or weight of the bucket onto the wheels, and then maintain the actuators in the desired position by movement of the shuttle valve into its neutral or blocking position.

As also shown in FIG. 6, another hydraulic line 48 connects the cylinder on the piston end of one actuator 15 with branch lines 49 and 50 connecting with the piston ends of the actuators 35 for the skid shoes, and additional lines 51 and 52 connect the rod ends of the skid shoe actuators with the rod ends of the frame actuators 15. As a consequence, when the shuttle valve 40 is in its righthand position to admit hydraulic fluid to the rod ends of the actuators 15, such hydraulic fluid will flow from the actuators 15 through the lines 51 and 52 into the rod ends of the actuators 35, while hydraulic fluid in the piston ends of the actuators 35 is exhausted through lines 48, 49 and 50 into the piston ends of the actuators 15, and thence back to the source of hydraulic fluid. Thus, as the actuators 15 are retracted so as to raise the wheels, and thus lower cutting edge 16, the actuators 35 are also retracted so as to raise the skid shoes (see FIG. 1).

On the other hand, when the shuttle valve is shifted to its lefthand position to supply hydraulic fluid through lines 44 and 47 into the piston ends of the actuators 15, such fluid will flow through lines 48, 49 and 50 into the piston ends of the actuators 35, while hydraulic fluid in the rod ends of the actuators 35 is permitted to exhaust through the lines 51 and 52 into the piston ends of actuators 15 and then through the hydraulic lines 46 and 47 back to the source. In this way, as the actuators 15 are extended so as to lower the wheels and thereby raise the cutting edge of the bucket, the skid shoes 26 are lowered to the position shown in FIG. 3. On the other hand, when the shuttle valve is so operated as to move the actuators 15 to an intermediate position, the actuators 35 are similarly caused to partially extend in order to force the skid shoes 26 into engagement with the ground surface, as shown in FIG. 2.

In use of the scraper, the shuttle valve is first moved to the righthand position so as to retract each of the actuators and thus move the cutting edge of the bucket to a desired level. As shown in FIG. 1, when the scraper has been towed forward to establish an initial cut at this level, the shuttle valve is manipulated to extend the actuators to an intermediate position and thereby transfer part of the load of the bucket to the wheels 12. At the same time, the actuators 35 for the skid shoes will be partially extended to force their bottom surfaces downwardly into engagement with the ground surface, as shown in FIG. 2. By proper manipulation of the shuttle valve, to raise or lower the wheels in response to a laser beam or the like, the cutting edge 16 may be maintained at grade level as the scraper moves forwardly.

If the skid shoes encounter irregularities in the ground surface, during this forward movement of the scraper, they are free to adapt themselves thereto in order to maintain contact with the ground surface. Thus, the hydraulic fluid within the interconnected piston ends of the actuators 35 and 15 acts as an accumulator to permit the legs 31 to extend or retract as necessary to adjust to the irregularities. Furthermore, due to this accumulator effect, the hydraulic fluid will continue to urge the shoes downwardly, so that the bottom surfaces of the skid shoes will continue to automatically adjust to the irregularities despite wear on the skid shoes.

As previously described, the skid shoes will continually be urged downwardly into engagement with the ground surface so as to absorb shock and limit vertical vibrations of the cutting edge as the wheels are caused to bounce as they encounter irregularities in the ground surface. Thus, for example, if the wheels should be caused to bounce upwardly, and thereby retract the actuators 15 to some extent, the resulting displacement in hydraulic fluid from the piston ends of the actuators 15 would force the actuators 35 toward a somewhat more extended position in order to accommodate the load otherwise lost by the wheels. Conversely, in the event the wheels are caused to bounce in a downward direction, extension of the actuators 15 will cause displacement of hydraulic fluid in their piston ends so as to permit the skid shoes to rise in order to accommodate the increased load accepted by the downwardly moving wheels. More particularly, the arrangement is such that the skid shoes are responsive to increased load in the bucket in that flattening of the tires 16A of the wheels 12 due to an accumulation of soil in the bucket will tend to retract the actuators 15 and thus displace hydraulic fluid from their piston ends into the piston ends of the actuators 35, thereby urging the actuators to extended postions to increase the force pushing downwardly on the skid shoes.

As indicated in the drawings, the cylinders of the actuators 35 are considerably smaller than the cylinders of the actuators 15. In this way, fluctuations in the extension and retraction of the actuators 35 due to tilting of the skid shoes forwardly or rearwardly to accommodate the irregularities in the ground surface will have a relatively small effect upon the actuators 15. That is, the actuators 15 will be caused to extend or retract, upon extension or retraction of the actuators 35, only a fraction of the amount that they would extend or retract if the cylinders of the two actuators were of the same size.

Also, a pressure regulator R is disposed within the hydraulic line 48 intermediate the piston end of actuator 15 to which it is connected and the connection of line 48 to lines 49 and 50. In this way, the skid shoes will not respond due to increased load on the bucket above a certain pressure level. That is, above this level, the pressure of the hydraulic fluid leading into the piston ends of the actuators 15 will not increase or decrease the amount of force with which the skid shoes are urged downwardly into engagement with the ground surface. In this way, the force with which the legs 31 maintain the skid shoes in engagement with the ground surface may be limited so as to avoid causing breakage or other damage to the actuators.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. In a land leveling scraper, comprising a frame including a front section for connection to a towing vehicle, a rear section pivotally connected to the front section and having wheels with pneumatic tires carried thereon for engagement with the ground surface, a bucket supported by the frame and having a front opening through which soil may pass and a cutting edge across the lower edge of the front opening, and means including an hydraulically operated, cylinder and piston type actuator connecting the frame sections for causing them to swing about their pivotal connection in order to raise or lower the wheels and thus respectively lower or raise the cutting edge of the bucket with respect to the ground surface, and skid shoes each comprising a plate having a substantially flat bottom surface, and mounting on one of the frame sections for sliding over the ground surface during foward movement of the frame; the improvement wherein the forward end of each skid plate is pivotally connected to the one frame section, a leg is pivotally connected at its upper end to said one frame section and at its lower end to the skid plate rearwardly of the forward end thereof, one end of the leg having a cylinder and the other a piston slidable within the cylinder moving the bottom surface of the plate toward or away from the ground surface, and an hydraulic system including a source of hydraulic fluid connected with the cylinders on opposite sides of the pistons thereon.

2. A scraper of the character defined in claim 1, wherein the pivotal connection of the front end of each skid plate to the one frame section comprises a link pivotally connected at one end to said one frame section and at the other end to the front end of the skid plate, whereby the plate may be lifted above the cutting edge as said wheels are raised to lower said edge against the ground surface.

3. A scraper of the character defined in claim 1, wherein the one frame section is the first section, and the actuators connecting the frame sections are retracted to raise the wheels and lower the cutting edge, and extended to lower the wheels and raise the cutting edge.

4. A scraper of the character defined in claim 3, wherein the hydraulic system includes means for retracting the actuator connecting the frame sections as the actuator for mounting each of the skid shoes is retracted, and for extending the frame actuator as the skid shoe actuators are extended.

5. A scraper of the character defined in claim 2, wherein the frame cylinder is connected to each of the leg cylinders in such a manner that the shoes are urged against the ground surface with a force proportional to the load on the bucket.

6. A scraper of the character defined in claim 2, wherein the bucket is fixed to the front frame section, each leg extends downwardly and rearwardly of the bucket, and the link is pivotally connected to the rear end of the bottom wall of the bucket.

7. In a land leveling scraper, comprising a frame having a front end for connection to a towing vehicle, a rear end having wheels with pneumatic tires carried thereon for engagement with the ground surface, a bucket supported by the frame and having a front opening through which soil may pass and a cutting edge across the lower edge of the front opening, means for raising and lowering the cutting edge of the bucket with respect to the ground surface, and skid shoes each comprising a plate having a substantially flat bottom surface which is mounted on the frame for sliding over the ground surface during forward movement of the frame; the improvement wherein the forward end of each skid plate is pivotally connected to the frame, a leg having an upper end pivotally connected to the frame and a lower end pivotally connected to the skid plate rearwardly of the forward end of said skid plate, one end of the leg having a cylinder and the other end thereof having a piston slidable within the cylinder to form a variable volume pressure chamber connectible to a source of hydraulic fluid under pressure in order to yieldably urge the leg to extended position and thus the bottom surface of the plate against the ground surface.

8. A scraper of the character defined in claim 7, wherein the pivotal connection of the front end of each skid plate to the frame comprises a link pivotally connected at one end to the frame and at the other end to the front end of the skid plate, and a means is provided for introducing hydraulic fluid to or exhausting hydraulic fluid from the cylinder on opposite sides of the piston in order that the leg may be retracted to lift the plate above the cutting edge as the wheels are raised to lower said edge against the ground surface.

9. A scraper of the character defined in claim 7, including means for urging the shoe against the ground surface with a force which is proportional to the load on the bucket.

10. A scraper of the character defined in claim 8, wherein the means for raising and lowering the cutting edge of the bucket comprises an hydraulically operated, cylinder and piston type actuator, and means for introducing hydraulic fluid to or exhausting hydraulic fluid from the cylinder on opposite sides of the piston, and the frame cylinder is connected to each of the leg cylinders in such a manner that the shoes are urged against the ground with a force proportional to the load on the bucket.

* * * * *